US011541260B2

(12) United States Patent
Chattaway et al.

(10) Patent No.: US 11,541,260 B2
(45) Date of Patent: Jan. 3, 2023

(54) FIRE SUPPRESSION SYSTEM AND METHOD

(71) Applicant: Kidde Graviner Limited, Slough (GB)

(72) Inventors: Adam Chattaway, Old Windsor (GB); Terry Simpson, Wake Forest, NC (US); Tadd F. Herron, Chocowinity, NC (US)

(73) Assignee: Kidde Graviner Limited, Slough (GB)

( * ) Notice: Subject to any disclaimer, the term of this patent is extended or adjusted under 35 U.S.C. 154(b) by 75 days.

(21) Appl. No.: 16/904,153

(22) Filed: Jun. 17, 2020

(65) Prior Publication Data

US 2020/0316419 A1 Oct. 8, 2020

Related U.S. Application Data

(63) Continuation of application No. 15/089,822, filed on Apr. 4, 2016, now abandoned.

(51) Int. Cl.

| | |
|---|---|
| ***A62C 35/64*** | (2006.01) |
| ***A62C 35/68*** | (2006.01) |
| ***A62C 35/02*** | (2006.01) |
| ***A62C 3/08*** | (2006.01) |
| ***A62C 37/44*** | (2006.01) |
| ***A62C 99/00*** | (2010.01) |
| ***A62C 35/58*** | (2006.01) |

(52) U.S. Cl.

CPC ..... *A62C 35/645* (2013.01); *A62C 3/08* (2013.01); *A62C 35/023* (2013.01); *A62C 35/58* (2013.01); *A62C 35/68* (2013.01); *A62C 37/44* (2013.01); *A62C 99/0018* (2013.01)

(58) Field of Classification Search

CPC ..... A62C 35/645; A62C 35/023; A62C 35/58; A62C 35/68; A62C 3/08; A62C 37/44; A62C 99/0018; A62C 99/009; A62C 99/0009

USPC ..... 169/11

See application file for complete search history.

(56) References Cited

U.S. PATENT DOCUMENTS

| | | | | |
|---|---|---|---|---|
| 6,003,608 | A | 12/1999 | Cunningham | |
| 6,082,464 | A | 7/2000 | Mitchell et al. | |
| 7,726,409 | B2 * | 6/2010 | Haaland | A62C 3/08 169/46 |

(Continued)

*Primary Examiner* — Tuongminh N Pham
*Assistant Examiner* — Juan C Barrera
(74) *Attorney, Agent, or Firm* — Carlson, Gaskey & Olds, P.C.

(57) ABSTRACT

A fire suppression system includes at least one high pressure gas source containing an inert gas, at least one low pressure gas source containing an organic halide gas, a distribution network connected with the high pressure gas source and the low pressure gas source to distribute the inert gas and the organic halide gas, and a controller in communication with the distribution network. The distribution network includes flow control devices configured to control flow of the inert gas and the organic halide gas. The controller is configured to initially release the inert gas in response to a fire threat to reduce an oxygen concentration at the fire threat below a preset oxygen concentration threshold, and release the organic halide gas to increase an organic halide gas concentration at the fire threat above a preset organic halide gas concentration threshold while the oxygen concentration is below the preset oxygen concentration threshold.

19 Claims, 3 Drawing Sheets

(56) References Cited

U.S. PATENT DOCUMENTS

| | | | | |
|---|---|---|---|---|
| 8,813,858 | B2 | 8/2014 | Gastonides et al. | |
| 2011/0308823 | A1* | 12/2011 | Seebaluck ..... | A62C 99/0018 169/46 |
| 2012/0012346 | A1 | 1/2012 | Chattaway et al. | |
| 2012/0217027 | A1 | 8/2012 | Chattaway et al. | |
| 2015/0034342 | A1 | 2/2015 | Seebaluck et al. | |
| 2015/0283412 | A1 | 10/2015 | Kono et al. | |

* cited by examiner

FIRE SUPPRESSION SYSTEM AND METHOD

CROSS-REFERENCE TO RELATED APPLICATIONS

This application is a continuation of U.S. Ser. No. 15/089,822, filed Apr. 4, 2016, which is incorporated herein in its entirety.

BACKGROUND

Fire suppression systems widely vary depending upon the location and expected type of fire threat. Generally, such systems may utilize water, wet chemical agents, dry chemical agents, or other fire suppressants. While each system shares the objective of fire suppression, the location of the system often limits the type of suppressant used.

Aircraft, buildings, and other structures that have contained areas have typically utilized halogenated suppressants, such as halons. Halogens are believed to play a role in ozone depletion of the atmosphere. While many systems for buildings or other land structures have replaced halon, space and weight limitations in aviation applications impede replacement.

SUMMARY OF THE INVENTION

A fire suppression system according to an example of the present disclosure includes at least one high pressure gas source containing an inert gas, at least one low pressure gas source containing an organic halide gas, and a distribution network connected with the high pressure gas source and the low pressure gas source to distribute the inert gas and the organic halide gas. The distribution network includes flow control devices configured to control flow of the inert gas and the organic halide gas, and a controller in communication with the distribution network. The controller is configured to initially release the inert gas in response to a fire threat to reduce an oxygen concentration at the fire threat below a preset oxygen concentration threshold, and release the organic halide gas to increase an organic halide gas concentration at the fire threat above a preset organic halide gas concentration threshold while the oxygen concentration is below the preset oxygen concentration threshold.

In a further embodiment of any of the foregoing embodiments, the controller is configured to release the organic halide gas in response to a reduction of the oxygen concentration at the fire threat below the preset oxygen concentration threshold.

In a further embodiment of any of the foregoing embodiments, the controller is configured to release the organic halide gas in response to a peak mass flow rate of the inert gas.

In a further embodiment of any of the foregoing embodiments, the controller is configured to release the organic halide gas in response to a minimum oxygen concentration at the fire threat.

In a further embodiment of any of the foregoing embodiments, once the organic halide gas concentration at the fire threat is above the preset organic halide gas concentration threshold. The controller is configured to maintain the organic halide gas concentration at the fire threat above the preset organic halide gas concentration threshold exclusive of whether the oxygen concentration at the fire threat is below or above the preset oxygen concentration threshold.

In a further embodiment of any of the foregoing embodiments, the distribution network includes a common manifold.

In a further embodiment of any of the foregoing embodiments, the distribution network includes input lines respectively connecting the at least one high pressure gas source with the common manifold and the at least one low pressure gas source with the common manifold, output lines respectively leading from the common manifold, and flow control devices configured to control flow of the inert gas and the organic halide gas.

In a further embodiment of any of the foregoing embodiments, the controller is also configured to select which of the inert gas or the organic halide gas is distributed based upon a location of a fire threat.

In a further embodiment of any of the foregoing embodiments, the controller is configured to release the organic halide gas into a flow of the inert gas prior to the location of the fire threat.

In a further embodiment of any of the foregoing embodiments, the distribution network includes a first line connected with the at least one high pressure gas source, a second line connected with the at least one low pressure gas source, and a venturi flow control device connecting the second line with the first line.

A method according to an example of the present disclosure includes initially releasing an inert gas from at least one high pressure gas source in response to a fire threat to reduce an oxygen concentration at the fire threat below a preset oxygen concentration threshold, and releasing an organic halide gas from at least one low pressure gas source to increase an organic halide gas concentration at the fire threat above a preset organic halide gas concentration threshold while the oxygen concentration is below the preset oxygen concentration threshold.

A further embodiment of any of the foregoing embodiments includes releasing the organic halide gas in response to a reduction of the oxygen concentration at the fire threat below the preset oxygen concentration threshold.

A further embodiment of any of the foregoing embodiments includes releasing the organic halide gas in response to a peak mass flow rate of the inert gas.

A further embodiment of any of the foregoing embodiments includes the organic halide gas in response to a minimum oxygen concentration at the fire threat.

A further embodiment of any of the foregoing embodiments includes, once the organic halide gas concentration at the fire threat is above the preset organic halide gas concentration threshold, maintaining the organic halide gas concentration at the fire threat above the preset organic halide gas concentration threshold exclusive of whether the oxygen concentration at the fire threat is below or above the preset oxygen concentration threshold.

A further embodiment of any of the foregoing embodiments includes releasing the organic halide gas into a flow of the inert gas prior to the location of the fire threat

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
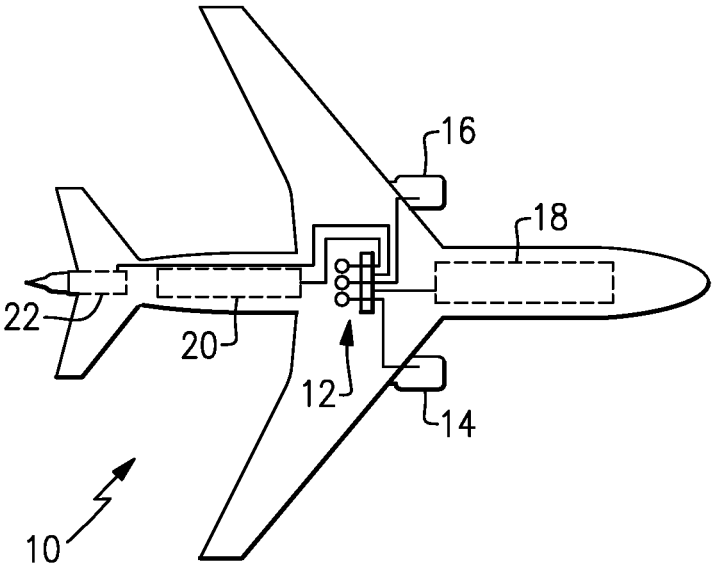
FIG. 1 illustrates an aircraft with a fire suppression system.

FIG. 1 illustrates an example aircraft 10 with a fire suppression system 12 that is configured to provide fire suppression to multiple different compartments 14/16/18/20/22. In this example, compartments 14 and 16 are gas turbine engine compartments, compartment 18 is a forward cargo compartment, compartment 20 is an aft cargo compartment, and compartment 22 is an auxiliary power turbine engine unit. Such compartments 14/16/18/20/22 are of different volumetric sizes and may also have different fire suppression needs. Heretofore, such different compartments might have utilized their own dedicated independent halogen fire suppression system to individually address the particular size of the compartment and its suppression needs. However, the fire suppression system 12 is a single system that intelligently serves all of the compartments 14/16/18/20/22 and thus may be utilized to reduce cost and weight, and to partially replace use of halogenated suppressants.

Figure 2:
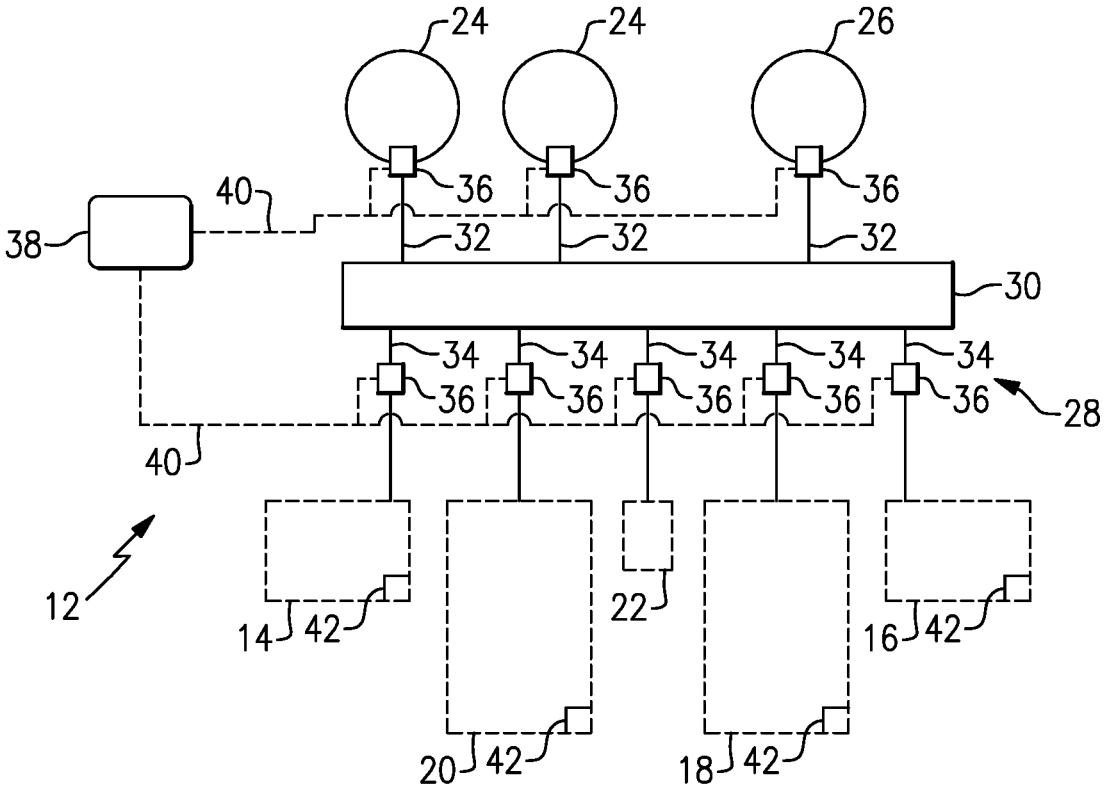
FIG. 2 illustrates an example of a fire suppression system.

FIG. 2 illustrates a schematic view of the fire suppression system 12 (hereafter "system 12"). The system 12 includes at least one first, high pressure or high flow gas source 24 (two shown) containing an inert gas and at least one second, low pressure or low flow gas source 26 containing an organic halide gas. Although the illustrated example depicts two of the first gas sources 24, a single first gas source 24 or additional first gas sources 24 could be used. Similarly, although the illustrated example depicts a single second gas source 26, additional second gas sources 26 could be used.

The phrases "high pressure" and "low pressure" may refer to the pressure under which the material is contained and/or to the maximum mass flow rate at which the gas can be provided. Thus, the high pressure gas source 24 is also considered to be a high flow rate gas discharge source, and the low pressure gas source 26 is also considered to be a low flow rate gas discharge source. Most typically, the high pressure gas source 24 and the low pressure gas source 26 will be gas tanks that are configured to contain and store the respective gases under flight conditions of the aircraft 10 if or until fire suppression is needed. For example, the inert gas is nitrogen, helium, argon, carbon dioxide, or mixtures thereof, and the organic halide gas is bromotrifluoromethane. Bromotrifluoromethane is also known as "halon" or "halon 1301."

The system 12 further includes a distribution network 28 that is connected with the high pressure gas source 24 and the low pressure gas source 26 to selectively distribute the inert gas and/or the organic halide gas to the compartments 14/16/18/20/22. The distribution network 28 includes a common manifold 30, input lines 32 that connect the high pressure gas sources 24 and the low pressure gas source 24 with the common manifold 30, output lines 34 that lead from the common manifold 30 to the compartments 14/16/18/20/22, and flow control devices 36.

As an example, the common manifold 30 is of a larger size than the individual input lines 32 and output lines 34. For instance, the common manifold 30 has a cross-sectional size and each of the individual input lines 32 and output lines 34 have a cross-sectional size such that the cross-sectional size of the common manifold is at least about 200% larger than the cross-sectional size of the individual input lines 32 and output lines 34. Such size differential could be varied to 125%, 150%, 175%, or up to 500%.

In a further example, the distribution system 28 includes X number of input lines 32 that lead into the common manifold 30 and Y number of output lines 34 that lead out from the common manifold 30. Although not limited, in one example, Y may be greater than X. In the illustrated example, X is 3 and Y is 5, for a ratio of 3:5. In modified examples that have different numbers of compartments and/or gas sources, the ratio is 3:4, 2:3, 2:4, 2:5, or Y is less than or equal to X.

The common manifold 30 permits the high pressure gas source 24 and the low pressure gas source 26, or multiples of these, to be integrated into a single, compact system. For instance, the common manifold 30 may reduce the need for splits in the lines and additional line length that would otherwise add cost and weight. The common manifold 30 also permits each gas to be rapidly provided on-demand to any of the compartments 14/16/18/20/22, and thus reduces or eliminates the need for individual dedicated systems.

The flow control devices 36 are configured to control flow of the inert gas and the organic halide gas in the distribution network 28. For example, the flow control devices 36 may be valves that are configured to open and close flow, metering valves that are configured to control mass flow, check valves, or combination valves that serve multiple functions of opening/closing, metering, and preventing backflow.

In the example shown, there is a respective flow control device 36 located at each of the high pressure gas sources 24 and at the low pressure gas source 26. These flow control devices 36 may be on or integrated with the gas tanks, for example. There is also a respective flow control device 36 located in each output line 34, spaced apart from the common manifold 30, for example. These flow control devices serve to open and close flow from the common manifold 30 to the respective compartments 14/16/18/20/22 and may also serve to control mass flow.

The system 12 also includes a controller 38. The controller 38 may include software, hardware (e.g., one or more microprocessors), or both that is configured or programmed to perform the functions described herein. The controller 38 is in communication with the distribution network 28. For example, the controller 38 is in communication with each of the flow control devices 36, as represented by communication lines 40. As will be appreciated, the controller 38 may also be in communication with other systems or controllers of the aircraft 10.

Each compartment 14/16/18/20/22 may also have a detection system 42 that is capable of detecting whether there is a fire threat in the given compartment 14/16/18/20/22. Such detection systems 42 are generally known and are thus not described further herein. When a threat is detected, a signal is communicated to the controller 38. The controller 38 then selects how the inert gas and the organic halide gas, if used, are distributed based upon which compartment 14/16/18/20/22 has the fire threat. In this regard, the controller 38 may be pre-programmed with information or look-up tables that the controller 38 uses to control gas distribution.

In an initial default state, all of the flow control devices 36 may be closed such that there is no flow through the system 12. Given a fire threat in one of the compartments 14/16/18/20/22, the controller 38 opens the flow control device 36 of the selected one of the high pressure gas source 24 or the low pressure gas source 26, and opens the flow control device 36 in the output line 34 that leads to that compartment. The gas from either the high pressure gas source 24, the low pressure gas source 26, or both flows into the common manifold 30 and then into the output line 34 that leads to that compartment.

Figure 3:
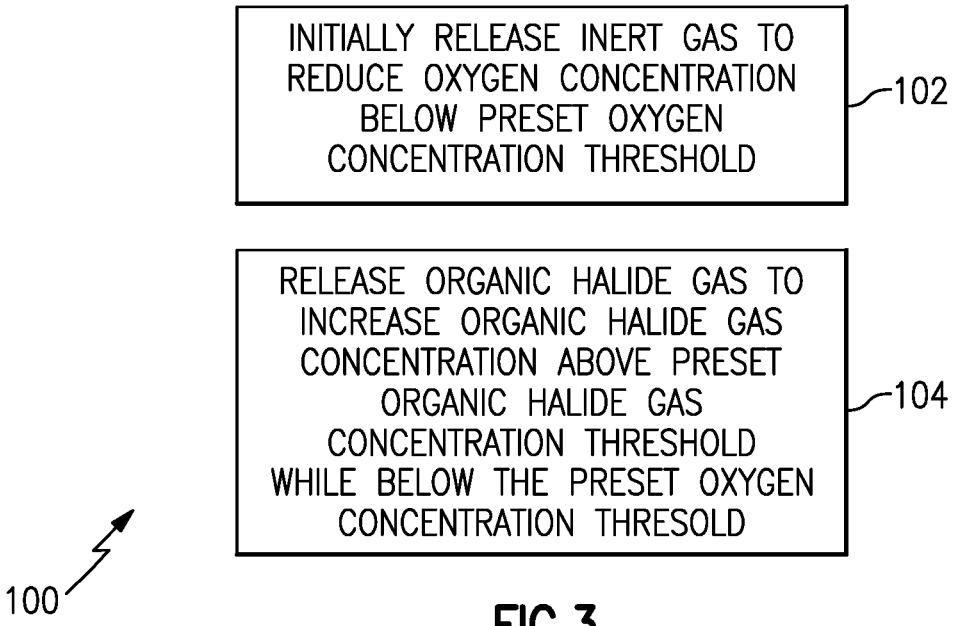
FIG. 3 illustrates a method for use with a fire suppression system.

For one or more particular ones of the compartments 14/16/18/20/22, such as the forward or aft cargo compartments 18/20, the controller 38 is configured to distribute both the inert gas and the organic halide gas in a controlled manner, as shown in a block diagram method 100 in FIG. 3. At 102 the controller 38 is configured to initially release the inert gas in response to the fire threat to reduce (e.g., "knock down") an oxygen concentration at the fire threat below a preset oxygen concentration threshold.

At 104, the controller 38 is configured to release the organic halide gas to increase an organic halide gas concentration at the fire threat above a preset organic halide gas concentration threshold while the oxygen concentration is below the preset oxygen concentration threshold. Thus, at least for a period of time before the oxygen concentration may increase above the oxygen concentration threshold, the oxygen concentration is below the oxygen concentration threshold and the organic halide gas concentration is above the preset organic halide gas concentration threshold. Such a methodology may also be advantageous for testing or certification circumstances of the inert gas and/or the organic halide gas. For instance, the inert gas and the organic halide gas can be independently certified without the need for complex "fractional contribution" calculations because the oxygen concentration is initially knocked down below the threshold level and the organic halide gas is established above the organic halide gas concentration level. That is, although the inert gas and the organic halide gas work cooperatively for fire suppression, each of the inert gas and the organic halide gas independently meets its own threshold as if it were independently suppressing the fire threat.

In further examples, the controller 38 is pre-programmed with a trigger parameter that is used to trigger the release of the organic halide gas. The inert gas has the potential to dilute and/or displace the organic halide gas in the given compartment 14/16/18/20/22 that has the fire threat (assuming that there is ventilation of the compartment), thereby potentially causing it to decrease below the preset organic halide gas concentration threshold. To reduce the potential for such a decrease, the controller 38 may be configured to release the organic halide gas with respect to the trigger parameter.

One example trigger parameter is an instant or detected oxygen concentration in the given compartment 14/16/18/20/22 that has the fire threat. Such an instant or detected concentration level may be provided by the detection system 42. For example, the controller 38 is configured to release the organic halide gas in response to a reduction of the instant or detected oxygen concentration below the preset oxygen concentration threshold. Thus, the organic halide gas is released upon the oxygen concentration crossing the preset oxygen concentration threshold. This ensures that the release of the organic halide gas lags the primary release of the inert gas that is used to initially knock down the oxygen concentration. Although not limited, such an approach would most typically be employed in the cargo compartments 18/20.

Rather than releasing the organic halide gas upon the oxygen concentration crossing the preset oxygen concentration threshold, the controller 38 may alternatively be configured to release the organic halide gas in response to a minimum oxygen concentration in the given compartment 14/16/18/20/22. The minimum oxygen concentration may be a preset or calculated minimum based upon the size of the given compartment 14/16/18/20/22 and the amount of inert gas released, or an instant or detected minimum. For example, a continuous decrease in the instant or detected oxygen concentration followed by a change to an increase in the instant or detected oxygen concentration is indicative of a minimum and may be used as the trigger parameter for the release of the organic halide gas. This ensures that the release of the organic halide gas lags, to an even greater extent, the primary release of the inert gas that is used to initially knock down the oxygen concentration. Although not limited, such an approach would most typically be employed in the cargo compartments 18/20.

Another example trigger parameter is mass flow rate of the inert gas. A high mass flow of inert gas into the given compartment 14/16/18/20/22 after release of the organic halide gas may dilute or displace the organic halide gas. To avoid or eliminate the potential for such a decrease, the controller 38 may be configured to release the organic halide gas in response to a peak mass flow rate of the inert gas. For example, the controller 38 is configured to release the organic halide gas at a predetermined time period after the peak mass flow rate of the inert gas. This can also be used to ensure that the release of the organic halide gas into the given compartment 14/16/18/20/22 lags the peak mass flow of the inert gas into the compartment 14/16/18/20/22 such that the large influx of inert gas does not dilute or displace the organic halide gas. Although not limited, such an approach would most typically be employed in the cargo compartments 18/20.

Dilution or displacement of the organic halide gas can additionally or alternatively be managed by controlling how the organic halide gas is distributed in the distribution network 28. Although the methodologies herein are not limited to the system 12, if the system 12 is used, the organic halide gas can be distributed by adding the flow of organic halide gas into the flow of the inert gas prior to distribution into the given compartment 14/16/18/20/22. In the distribution network 28 this can be achieved by opening both the high pressure gas source 24 and the low pressure gas source 26 such that the inert gas and the organic halide gas mix in the manifold 30 before distribution into the given compartment 14/16/18/20/22.

Figure 4:
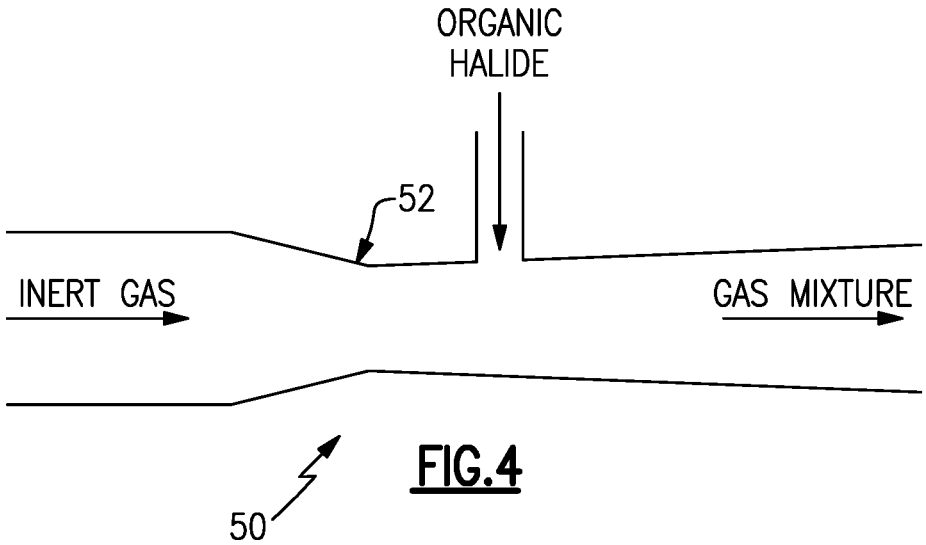
FIG. 4 illustrates an example of a venturi flow control device.

Alternatively, the plumbing of the input lines 32 and/or output lines 34 can be modified such that the flows of inert gas and organic halide gas can be selectively combined. In such an example, or in other systems besides the system 12 that employ the methodologies disclosed herein, a venturi flow control device 50 may be used, as shown in FIG. 4. The venturi flow control device 50 includes a venturi section 52 that narrows the flow path of the inert gas. The narrowing of the flow path, or throat, causes a reduction in downstream pressure. The organic halide gas can then be introduced at the location of reduced pressure. This enables the relatively lower pressure organic halide gas to be mixed into the higher pressure inert gas. A check valve may be used in the line of the organic halide gas to prevent back flow.

The method 100 may further include maintaining the organic halide gas concentration at the fire threat above the preset organic halide gas concentration threshold by continuing to provide and control flow of the organic halide gas to the given compartment 14/16/18/20/22. For example, once the organic halide gas concentration at the fire threat is above the preset organic halide gas concentration threshold, the controller 38 is configured to maintain the organic halide gas concentration at the fire threat above the preset organic halide gas concentration threshold exclusive of whether the oxygen concentration at the fire threat is below or above the preset oxygen concentration threshold. Thus, from ventilation, the oxygen concentration may increase, but even if it increases above the preset oxygen concentration threshold, the organic halide gas concentration is maintained above the preset organic halide gas concentration threshold to suppress the fire threat.

The preset oxygen concentration threshold and the preset organic halide gas concentration threshold of the examples herein may be set according to the given compartment and fire suppression needs. In a further example, the preset oxygen concentration threshold is 12 vol % and the preset organic halide gas concentration threshold is 3 vol %. Alternatively, the preset organic halide gas concentration threshold is up to 6 vol % or up to 9 vol %.

Figure 5:
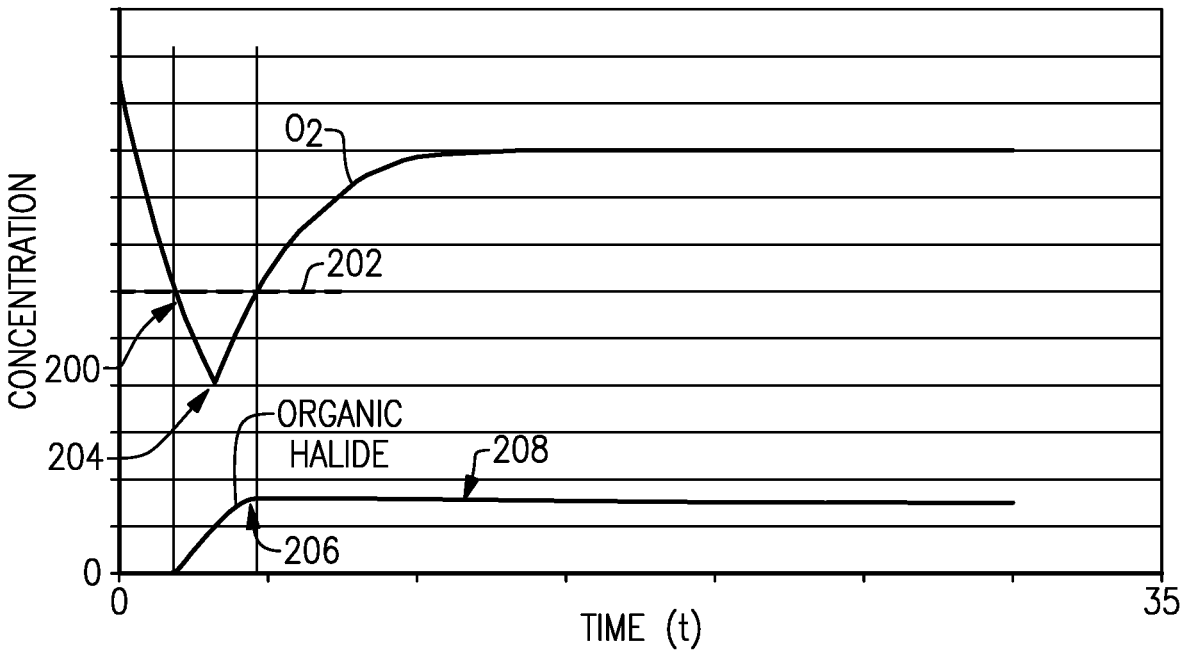
FIG. 5 is a graph of concentration versus time over a fire threat event.

FIG. 5 graphically depicts concentration of oxygen ($O_2$) and organic halide gas versus time during a fire threat event. Initially the oxygen concentration is relatively high. Upon initial release of the inert gas, the oxygen concentration decreases until at 200 it crosses the preset oxygen concentration threshold 202. With continued release of the inert gas the oxygen concentration continues to decrease to a minimum concentration at 204. The minimum concentration may coincide with cessation of release of the inert gas or reduced mass flow of the inert gas.

Depending on the trigger parameter, the organic halide gas is also released while the oxygen concentration is below the threshold 202. The organic halide gas concentration increases until reaching the organic halide gas concentration threshold 206. The threshold 206 is reached prior to the oxygen concentration increasing above the threshold 202 (due to ventilation). At 208, the organic halide gas concentration is maintained, even though the oxygen concentration has crept above the threshold 202.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can be determined by studying the following claims.

What is claimed is:

1. A fire suppression system comprising:

at least one high pressure gas source containing an inert gas;

at least one low pressure gas source containing an organic halide gas;

a distribution network connected with the at least one high pressure gas source and the at least one low pressure gas source to distribute the inert gas and the organic halide gas, the distribution network including flow control devices configured to control flow of the inert gas and the organic halide gas; and a controller in communication with the distribution network, the controller configured to, initially release the inert gas in response to a fire threat to reduce an oxygen concentration at the fire threat below a preset oxygen concentration threshold, and release the organic halide gas to increase an organic halide gas concentration at the fire threat above a preset organic halide gas concentration threshold while the oxygen concentration is below the preset oxygen concentration threshold and in response to a peak mass flow rate of the inert gas.

2. The fire suppression system as recited in claim 1, further comprising a detector configured to detect the oxygen concentration at the fire threat.

3. The fire suppression system as recited in claim 1, wherein the controller is configured to release the organic halide gas in response to a reduction of the oxygen concentration at the fire threat below the preset oxygen concentration threshold.

4. The fire suppression system as recited in claim 1, wherein the controller is configured to release the organic halide gas in response to a minimum oxygen concentration at the fire threat.

5. The fire suppression system as recited in claim 1, wherein the controller is configured to maintain the organic halide gas concentration at the fire threat above the preset organic halide gas concentration threshold exclusive of whether the oxygen concentration at the fire threat is below or above the preset oxygen concentration threshold.

6. The fire suppression system as recited in claim 1, wherein the distribution network includes a common manifold and input lines respectively connecting the at least one high pressure gas source with the common manifold and the at least one low pressure gas source with the common manifold, and output lines respectively leading from the common manifold.

7. The fire suppression system as recited in claim 1, wherein the controller is also configured to select which of the inert gas or the organic halide gas is distributed based upon a location of a fire threat.

8. The fire suppression system as recited in claim 1, wherein the controller is configured to release the organic halide gas into a flow of the inert gas prior to the location of the fire threat.

9. A fire suppression system comprising:

at least one high pressure gas source containing an inert gas;

at least one low pressure gas source containing an organic halide gas;

a distribution network connected with the at least one high pressure gas source and the at least one low pressure gas source to distribute the inert gas and the organic halide gas, the distribution network including flow control devices configured to control flow of the inert gas and the organic halide gas; and a controller in communication with the distribution network, the controller configured to, initially release the inert gas in response to a fire threat to reduce an oxygen concentration at the fire threat below a preset oxygen concentration threshold, and release the organic halide gas to increase an organic halide gas concentration at the fire threat above a preset organic halide gas concentration threshold while the oxygen concentration is below the preset oxygen concentration threshold, and maintain the organic halide gas concentration at the fire threat above the preset organic halide gas concentration threshold exclusive of whether the oxygen concertation at the fire threat is below or above the preset oxygen concentration threshold.

10. The fire suppression system as recited in claim 9, wherein the controller is configured to release the organic halide gas in response to a minimum oxygen concentration at the fire threat.

11. The fire suppression system as recited in claim 9, wherein the controller is configured to release the organic halide gas in response to a peak mass flow rate of the inert gas.

12. The fire suppression system as recited in claim 9, wherein the distribution network includes a common manifold and input lines respectively connecting the at least one high pressure gas source with the common manifold and the at least one low pressure gas source with the common manifold, and output lines respectively leading from the common manifold.

13. The fire suppression system as recited in claim 9, wherein the controller is also configured to select which of the inert gas or the organic halide gas is distributed based upon a location of a fire threat.

14. The fire suppression system as recited in claim 9, wherein the controller is configured to release the organic halide gas into a flow of the inert gas prior to the location of the fire threat.

15. A fire suppression method comprising:

initially releasing an inert gas from at least one high pressure gas source via a distribution network connected with the at least one high pressure gas source to distribute the inert gas in response to a fire threat to reduce an oxygen concentration at the fire threat below a preset oxygen concentration threshold, the distribution network including flow control devices configured to control flow of the inert gas; and releasing an organic halide gas from at least one low pressure gas source via the distribution network, the distribution network connected with the at least one low pressure gas source to distribute the organic halide gas, to increase an organic halide gas concentration at the fire threat above a preset organic halide gas concentration threshold while the oxygen concentration is below the preset oxygen concentration threshold and in response to a peak mass flow rate of the inert gas, the distribution network including flow control devices configured to control flow of the organic halide gas;

wherein a controller is configured to perform releasing of the inert gas and releasing of the organic halide gas by controlling each of the flow control devices.

16. The method as recited in claim 15, including releasing the organic halide gas in response to a reduction of the oxygen concentration at the fire threat below the preset oxygen concentration threshold.

17. The method as recited in claim 15, including releasing the organic halide gas in response to a minimum oxygen concentration at the fire threat.

18. The method as recited in claim 15, wherein, once the organic halide gas concentration at the fire threat is above the preset organic halide gas concentration threshold, maintaining the organic halide gas concentration at the fire threat above the preset organic halide gas concentration threshold exclusive of whether the oxygen concentration at the fire threat is below or above the preset oxygen concentration threshold.

19. The method as recited in claim 15, including releasing the organic halide gas into a flow of the inert gas prior to the location of the fire threat.

* * * * *